US007900928B2

(12) United States Patent
Held et al.

(10) Patent No.: US 7,900,928 B2
(45) **Date of Patent: *Mar. 8, 2011**

(54) TARGET GAME

(75) Inventors: Harry D. Held, East Meadow, NY (US); Juan C. Ceron, N. Merrick, NY (US); John E. Ceron, East Meadow, NY (US)

(73) Assignee: Sapo U.S.A. Corp., North Merrick, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/689,777

(22) Filed: Jan. 19, 2010

(65) Prior Publication Data

US 2010/0109248 A1 May 6, 2010

Related U.S. Application Data

(63) Continuation of application No. 11/668,253, filed on Jan. 29, 2007, now Pat. No. 7,673,881.

(51) Int. Cl.
*A63B 67/06* (2006.01)

(52) U.S. Cl. ..... 273/402; 273/398; 273/400; 273/394; 273/126 R; 273/123 R

(58) Field of Classification Search ..... 273/398, 273/400, 402, 126 R, 123 R, 394, 396, 108, 273/122 R, 118 R, 119 R
See application file for complete search history.

(56) References Cited

U.S. PATENT DOCUMENTS

| | | | |
|---|---|---|---|
| 175,254 | A | 3/1876 | Oberly |
| 406,342 | A | 7/1889 | Dumont |
| 469,554 | A | 2/1892 | Favor |
| 768,397 | A | 8/1904 | Norton et al. |
| 827,626 | A | 7/1906 | Gillet |
| 921,366 | A | 5/1909 | Connolly |
| 1,547,171 | A | 7/1925 | Huttlin |
| 1,918,094 | A | 7/1933 | Geekas |
| D107,744 | S | 1/1938 | Centerbar |
| 2,287,113 | A | 6/1942 | Markey |
| D192,148 | S | 1/1962 | Brodie |
| 3,300,215 | A | 1/1967 | Coffey, Sr. |
| D234,435 | S | 3/1975 | Pineiro, Jr. |
| 3,942,798 | A | 3/1976 | Koski |
| D240,248 | S | 6/1976 | Himmelman |

(Continued)

FOREIGN PATENT DOCUMENTS

WO WO2008/094314 A2 8/2008

OTHER PUBLICATIONS

International Application Serial No. PCT/US2007/079046, Search Report mailed Jul. 25, 2008.

(Continued)

*Primary Examiner* — Raleigh W. Chiu
(74) *Attorney, Agent, or Firm* — Hoffmann & Baron, LLP

(57) ABSTRACT

A target game to receive tokens into apertures having associated scores is provided. The target game includes a first playing surface, a second playing surface and a plurality of scoring bins. The first playing surface includes a plurality of first apertures. The second playing surface intersects the first playing surface and extends above from the first playing surface. The second playing surface includes a plurality of second apertures. The plurality of scoring bins is disposed below the first playing surface and in communication with the first apertures and the second apertures. Each of the scoring bins is in communication with a respective aperture of the first apertures and the second apertures.

20 Claims, 11 Drawing Sheets

U.S. PATENT DOCUMENTS

| | | | |
|---|---|---|---|
| 4,012,042 | A | 3/1977 | Blasingame |
| 4,323,250 | A | 4/1982 | Lansberry |
| 4,923,201 | A | 5/1990 | Nichol et al. |
| 4,936,590 | A | 6/1990 | Palmer |
| 4,968,041 | A | 11/1990 | Calvo |
| D333,492 | S | 2/1993 | Paredes |
| 5,204,612 | A | 4/1993 | Lingstaedt |
| 5,320,360 | A | 6/1994 | St. Pierre |
| D349,928 | S | 8/1994 | Rippin |
| 5,516,114 | A | 5/1996 | Michlin et al. |
| D420,397 | S | 2/2000 | Castro |
| D430,221 | S | 8/2000 | Quintana |
| 6,179,295 | B1 | 1/2001 | Lanza |

OTHER PUBLICATIONS

International Application Serial No. PCT/US2007/079046, Written Opinion mailed Jul. 25, 2008.

"The Frog Game", http://www.tradgames.org.uk/games/Pitching-Discs.htm, (Downloaded Aug. 21, 2006).

TARGET GAME

CROSS-REFERENCE TO RELATED APPLICATIONS

This application is a continuation of U.S. patent application Ser. No. 11/668,253 filed on Jan. 29, 2007, which is incorporated herein by reference in its entirety.

BACKGROUND

1. Field of Technology

This disclosure relates to target games. More particularly, this disclosure is directed to a target game that provides improved containment, greater scoring opportunities and is more challenging to the players, requiring greater skill and accuracy.

2. Brief Description of Related Art

There exist many target games of various configurations and rules. One game in particular—Sapo or Toad (or Frog)—is a toss-style game that is played by tossing tokens onto a horizontal surface, constituting a playing surface, of a generally wooden box structure having apertures of different values in the horizontal surface for receiving the tokens. The object of the game is to toss the tokens so that they fall through highest-valued apertures on the playing surface.

The apertures have different point values depending on their difficulty. One aperture, generally having the highest point value, is protected by the Sapo, which is the most difficult aperture as the token must be tossed into the Sapo's mouth to earn points. Tokens that fall through the apertures slide through channels toward the front of the game and are collected or received in open scoring bins, with the scoring bins being associated with the particular apertures on the playing surface. To increase the requisite skill level and scoring potential, larger number of apertures, smaller sizes thereof and obstacles (such as spinning wheels) have been employed.

Generally, from the playing surface there rise a pair of low-profile opposing sidewalls and a low-profile back wall, which provide a boundary about the playing surface. This boundary provides little containment of tokens that are tossed at the playing surface, as these tokens may skip on the playing surface and bounce off the playing surface over the boundary.

Furthermore, the open bins provide no protection from tokens errantly tossed directly into the scoring bins. Additionally, tokens that may have rolled or vacillated on their edges sliding through the channels into the scoring bins instead of sliding flatly may errantly bounce out of the open bins.

As improved game play and enjoyment are of importance in the target games, it would be advantageous to increase requisite skill level, ways of scoring and containment to improve the play and enjoyment of the game of Sapo.

SUMMARY

In accordance with an embodiment, there is provided a target game to receive tokens into apertures having associated scores. The target game includes a first playing surface, a second playing surface and a plurality of scoring bins. The first playing surface includes a plurality of first apertures. The second playing surface intersects the first playing surface and extends above from the first playing surface. The second playing surface also includes a plurality of second apertures. The plurality of scoring bins is disposed below the first playing surface and in communication with the first apertures and the second apertures. Each of the scoring bins is in communication with a respective aperture of the first apertures and the second apertures.

In accordance with another embodiment, there is provided a target game to receive tokens into apertures having associated scores. The target game includes a housing having a first playing surface, a second playing surface and a plurality of scoring bins. The housing includes at least opposing sidewalls and a top wall. The top wall is disposed between and extends along the opposing sidewalls. The top wall is configured as the first playing surface that includes a plurality of first apertures. The second playing surface intersects the first playing surface and extends above from the first playing surface. The second playing surface includes a plurality of second apertures. The plurality of scoring bins is disposed in the housing and in communication with the first apertures and the second apertures. Each of the scoring bins is in communication with a respective aperture of the first apertures and the second apertures.

BRIEF DESCRIPTION OF THE DRAWINGS

Various features and attendant advantages of the example embodiments will be more fully appreciated as the same becomes better understood when considered in conjunction with the accompanying drawings, in which like reference characters designate the same or similar parts throughout the several views, and wherein.

DETAILED DESCRIPTION

Figure 1A:
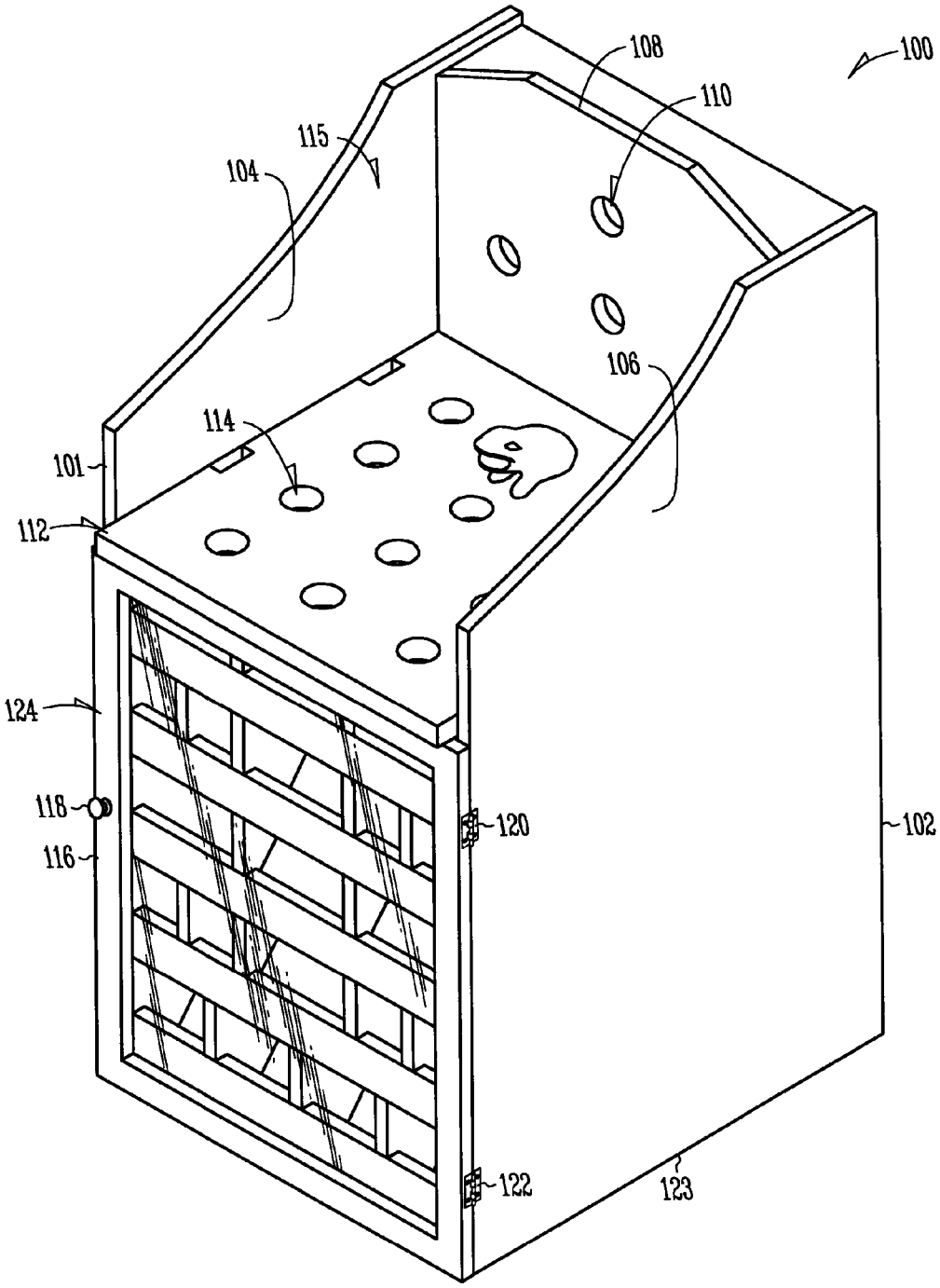
FIG. 1A illustrates a perspective view of an example target game.

FIG. 1A illustrates a perspective view 100 of an example target game. The example target game includes sidewalls 101 and 102, with each respective sidewall 101 and 102 having an upper curved portion 104 and 106. The example target game further includes a horizontal playing surface 112 and a vertical playing surface 108. The upper curved portions 104, 106 of the respective sidewalls 101, 102 and the playing surfaces 108, 112 form a game containment area 115 allowing a player to stand farther from the target game, yet contain the tossed tokens 125 (FIG. 1B) in the game containment area 115.

The vertical playing surface 108 includes plural apertures 110 and the horizontal playing surface includes 112 includes plural apertures 114. Apertures 110, 114 may include a variety or combinations of differently-shaped openings or slits in the respective playing surfaces 108, 112 to accept tokens 125 tossed by players at the target game. The variety of differently-shaped openings challenges the players, requiring greater skill and accuracy, provide different scoring opportunities, and increase enjoyment of the game. The vertical playing surface 108 also provides extra scoring opportunities and facilitates a variety of scoring schemes to be employed.

The apertures 110, 114 are sized such that tokens 125 (FIG. 1B) may be accepted through the respective apertures 110, 114. More specifically, some apertures may be round openings and larger than the circumference of the tokens 125, allowing the tokens 125 to fall through in any orientation (e.g., horizontal or vertical), while other apertures may be slits or openings that are larger than the thickness of the tokens 125 allowing (accepting) the tokens 125 that are vertical only (on edge) to fall through. Still another aperture may be elevated above the horizontal surface 112, e.g., a slit or opening in the mouth of a frog that accepts the tokens 125, which allows or accepts tokens 125 that are oriented horizontally only.

The example target game also includes a flat base 123 that rests on a surface, such as a floor. The horizontal playing surface 112, the sidewalls 101, 102 and base 123 form a housing that encloses plural scoring bins 124, which are associated with respective apertures 110, 114 of the horizontal and vertical playing surfaces 108, 112 and receive tokens 125 (FIG. 1B) falling through the respective apertures 110, 114.

The front of the example target game also includes a translucent door 116 rotatably affixed by hinges 120 and 122 to sidewall 102 (or alternatively to sidewall 101), depending on whether the door 116 should open to the left or to the right. Although the hinges 120, 122 are shown on the outside of the housing for clarity, it is to be noted that the hinges 120, 122 may be hidden hinges that are affixed to the interior of sidewall 102 (or alternatively to sidewall 101) and door 116. The outer part of the door 116 includes a knob 118 to open and close the door 116.

The door may be closed during play to enclose the scoring bins 124, preventing tokens 125 (FIG. 1B) falling through the apertures 110, 112 from errantly bouncing out of the scoring bins 124 and preventing tokens 125 being tossed directly into the scoring bins 124 resulting in unfair play. While the door 116 may be made entirely out of a particular material (e.g., wood, Plexiglas and the like), the door 116 may also include a Plexiglas or other translucent material in the center allowing the players to observe scoring bins 124 or receipt of tokens 125 in the scoring bins 124 during play. Upon completion of play (e.g., a particular game), or any time during thereof, the door 116 may be opened to remove the tokens 125 from the scoring bins 124 for the next round of play or for a new game.

Figure 1B:
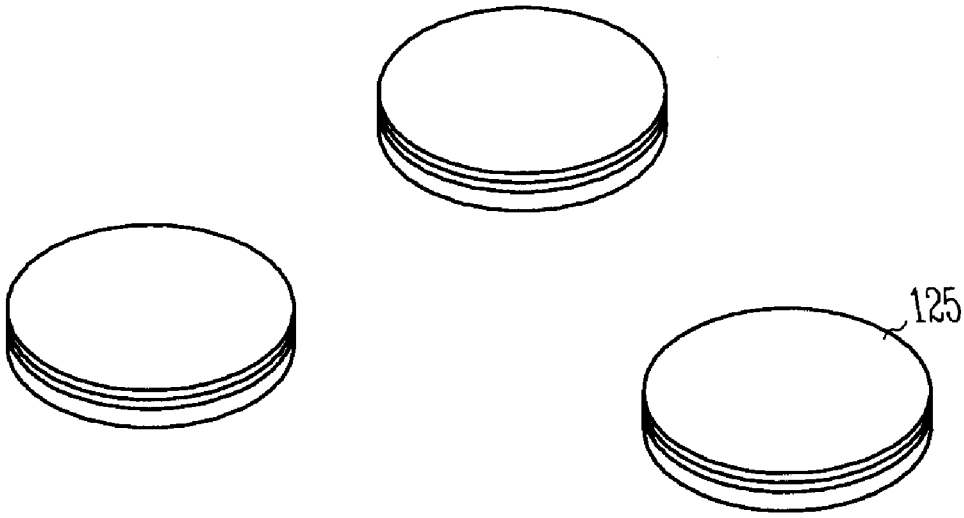
FIG. 1B illustrates a perspective view of tokens for playing the target game of FIG. 1A.

FIG. 1B illustrates a perspective view of tokens 125 for playing the target game of FIG. 1A. The tokens 125 are dimensioned for receipt via apertures 110 and 114 on the vertical playing surface 108 and the horizontal playing surface 112, respectively. More specifically, the tokens 125 may be of any shape (e.g., round, pentagonal, hexagonal, octagonal, and the like) which may be received via apertures 110, 114. The tokens 125 may be made of any material or combinations of materials, including metal (e.g., brass), yet be sufficiently heavy and durable to be easily tossed from a number of feet away from the target game for receipt via apertures 110 and 114.

Figure 2:
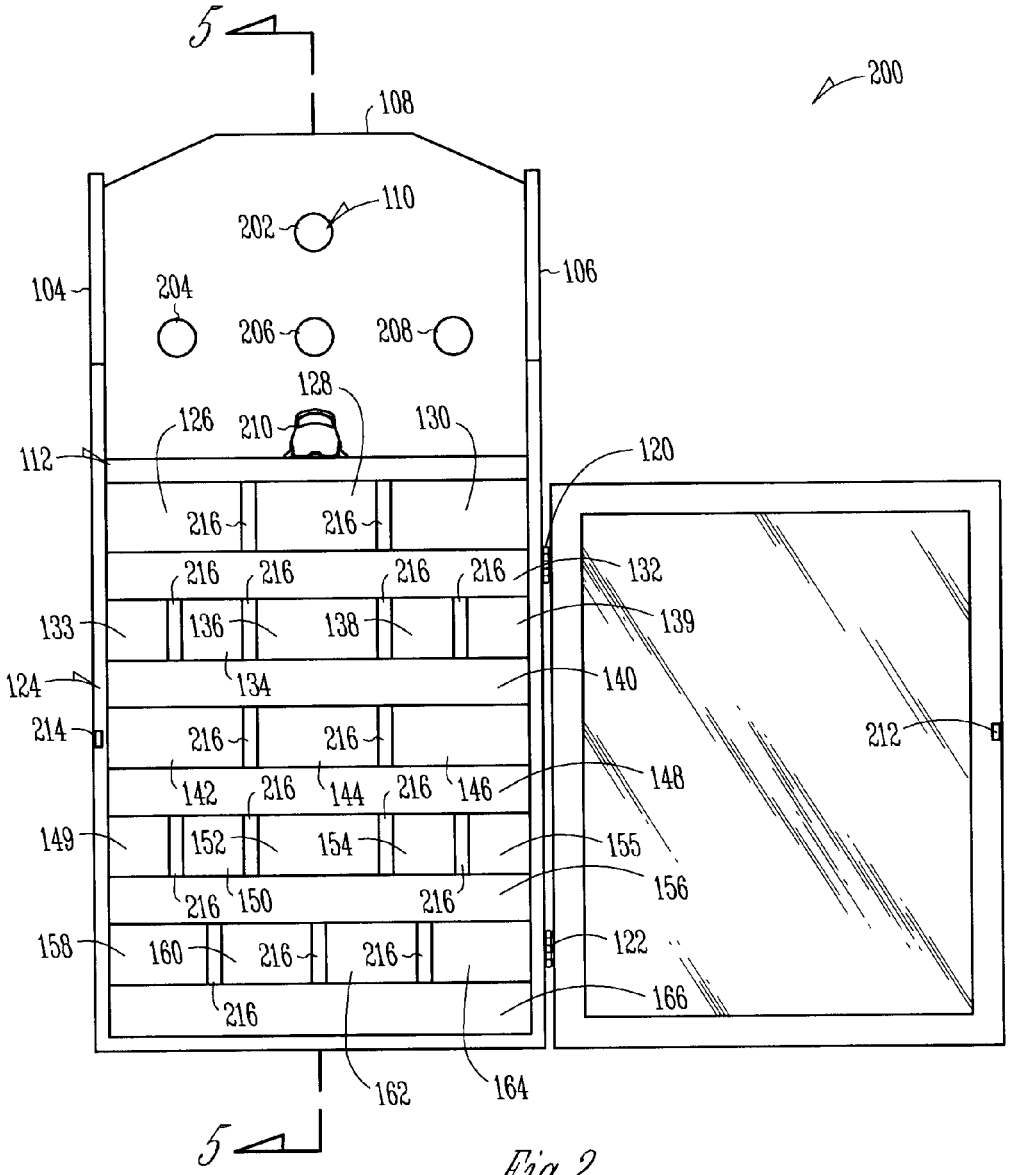
FIG. 2 illustrates a front view of the example target game of FIG. 1A.

FIG. 2 illustrates a front view 200 of the example target game of FIG. 1A. The front view 200 depicts various configurations of the apertures 110 on the vertical playing surface 108 and their respective scoring bins 124 to receive tokens 125 falling through the apertures 110. The vertical playing surface 108 may include dampening material to absorb or dampen momentum of tossed tokens 125 and to contain the tokens 125 in the game containment area 115 (shown in FIG. 1A). The apertures 114 on the horizontal playing surface 112 and their respective scoring bins 124 will be described in reference to FIG. 3 below. Although the Sapo or frog aperture 210 is illustrated in FIG. 2, it will also be described in reference to FIG. 3 below. The apertures 110 on the vertical playing surface 108 include apertures 202-208. At this point it is sufficient to mention that each of the apertures on the vertical playing surface 108 and the horizontal playing surface 112 is related to a respective scoring bin 124, as will be described in greater detail below.

The scoring bins 124 are arranged in five tiers of scoring bins 124, with the four top-most tiers corresponding to respective rows of apertures 114 of horizontal playing surface 112 described in reference to FIG. 3 below, and the lowest tier corresponding to apertures 110 in the vertical playing surface 108 (apertures 202-208). The first top-most tier includes three scoring bins 126-130 and a vertical stop member 132 to contain tokens 125 received in these scoring bins. The next lowest-tier includes five scoring bins 133-139 and a vertical stop member 140 to contain tokens 125 received in these scoring bins. Still the next lowest-tier includes three scoring bins 142-146 and a vertical stop member 148 to contain tokens 125 received in these scoring bins. Yet the next lowest-tier includes five scoring bins 149-155 and a vertical stop member 156 to contain tokens 125 received. Lastly, the bottom-most tier includes four scoring bins 158-164 and a vertical stop member 166. The vertical stop member 166 may be monolithic with the base 123 illustrated in FIG. 1A.

The scoring bins 124 of each tier receive tokens 125 from respective apertures 110, 114. As will be described in greater detail with reference to FIG. 5 below, the channels from apertures 110, 114, which lead to and form respective scoring bins 124 are separated by partitions 216 to keep tokens 125 segregated so that they may be collected in respective scoring bins 124.

The apertures 204-208 may be round openings through which tokens 125 are received and which fall through the apertures 204-208, sliding through respective channels (shown in FIG. 5) toward the front of the target game, being stopped by vertical stop member 166, and collected or received in respective scoring bins 158-164. It is noted that apertures 204-208 may also be slits that are oriented vertically or horizontally to receive tossed tokens 125 in the different orientations to increase requisite skill level, enhancing game play, providing different scoring opportunities and enjoyment.

The tokens 125 received through aperture 204 are collected in scoring bin 158, tokens 125 received through aperture 202 are collected in scoring bin 160, token received through aperture 206 are collected in scoring bin 162 and token received through aperture 208 are collected in scoring bin 164. The particular configuration of the apertures 110, including apertures 202-208, in relation to the channels connecting the apertures to the respective scoring bins 158-164 is illustrated and described in reference to FIG. 7 below.

An inner surface of the door 116 includes a locking mechanism 212 and sidewall 101 (FIG. 1A) includes a receiving mechanism 214 to secure the door 116 via the locking mechanism 212 in a closed position, such as during play (e.g., during a game), to prevent tokens 125 from errantly bouncing out of the scoring bins 124 and preventing tokens 125 being tossed directly into the scoring bins 124. The locking/securing mechanism 212, 214 may be a simple magnet/metal combination or another conventional device to secure the door 116 in a closed position.

Figure 3:
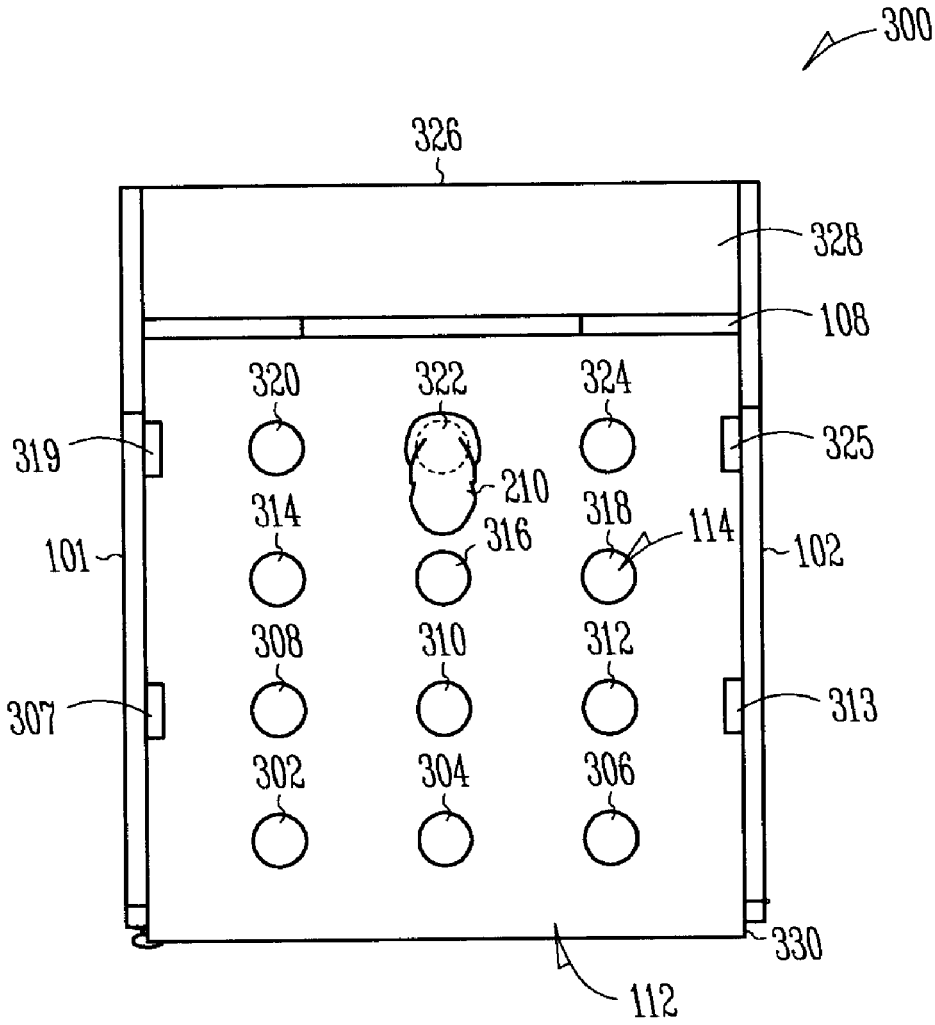
FIG. 3 illustrates a top view of the example target game of FIG. 1A.

FIG. 3 illustrates a top view 300 of the example target game of FIG. 1A. The top view 300 depicts the horizontal playing surface 112 including a variety of apertures 114, including round apertures 302-306, 308-312, 314-318, 320 and 324. The horizontal playing surface 112 may include dampening material to absorb or dampen momentum of tossed tokens 125 and to contain the tokens 125 in the game containment area 115 (shown in FIG. 1A). The horizontal playing surface 112 also includes apertures 307, 313, 319 and 325, which are slits that accept tokens 125 in a vertical orientation. The foregoing apertures 307, 313, 319 and 325 may be disposed at a variety of positions and in a variety of orientations (vertical, horizontal, diagonal) on the horizontal playing surface 112.

The horizontal playing surface 112 also includes the Sapo having aperture 210 (FIG. 2) in the frog's mouth that accepts tokens 125 in a horizontal orientation and feeds the received tokens to aperture 322 in the horizontal playing surface 112. The top view 300 further illustrates a back wall 326 and top wall 328 between and connecting the vertical playing surface 108 and the back wall 326. It should be noted that the horizontal playing surface 112 includes an extension portion 330 that extends out beyond the sidewalls 101 and 102 toward the player. The extension portion 330 provides an added playing surface to the horizontal playing surface 112, increasing the probability that tokens 125 land on the horizontal playing surface 112 instead of falling in front the target game and allowing the player to stand farther from the target game. Furthermore, as the extension portion 330 overhangs the door 116 when in a closed position during play, it also prevents the tokens tossed at the target game from falling behind the door 116 over its top.

With reference to FIGS. 2 and 3 concurrently, the horizontal playing surface 112 includes four rows of apertures 114, which are connected via respective channels (FIG. 5) to respective scoring bins 124 as follows. More specifically, the farthest row of apertures on the horizontal playing surface 112 includes apertures 319-325, which are associated with respective scoring bins 149-155. The next closest row includes apertures 314-318, which are associated with respective scoring bins 142-146. Yet the next closest row includes apertures 307-313, which are associated with respective scoring bins 133-139. Finally, the closest row of apertures includes apertures 302-306, which are associated with respective scoring bins 126-130. As can be seen, tokens 125 received via the apertures 114 on the horizontal surface 112 are collected in the respective scoring bins 124.

Figure 4:
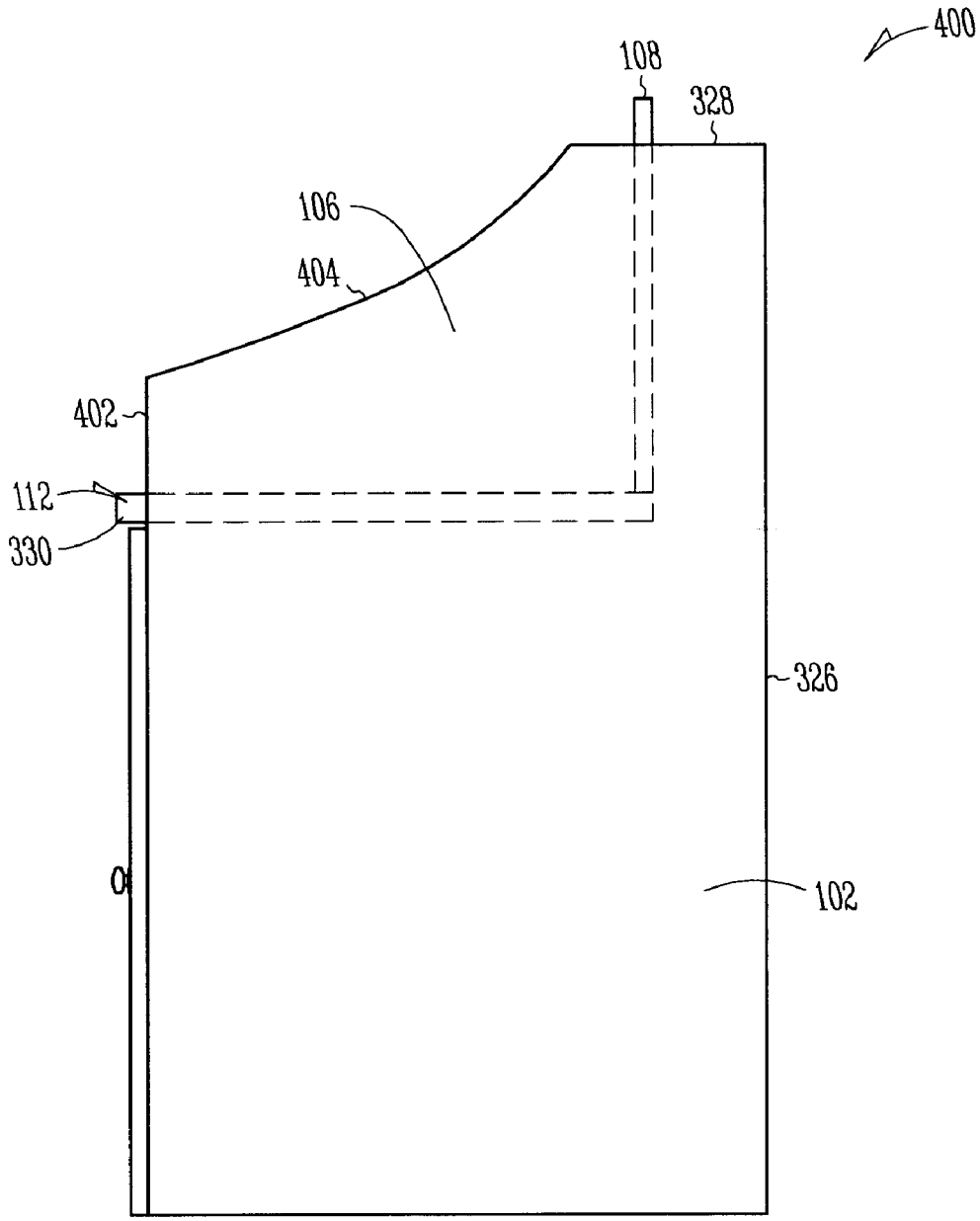
FIG. 4 illustrates a side view of the example target game of FIG. 1A.

FIG. 4 illustrates a side view 400 of the example target game of FIG. 1A. Side view 400 clearly illustrates the extension portion 330 of the horizontal playing surface 112 projecting or extending out past the sidewalls 101, 102 (sidewall 101 not shown in FIG. 4). Also illustrated in greater detail is sidewall 102 having the upper curved portion 106. It is noted that sidewall 101 (FIG. 1A) also has the upper curved portion 104 (FIG. 1A), which is analogous to the upper curved portion 106 of sidewall 102 as described below. The upper curved portion 106 of the sidewall 102 has an upward slope 404 that begins at a low-profile front edge 402 (about 4 inches above the horizontal playing surface 112) and terminates about the top of the vertical playing surface 108 (about 14 inches above the horizontal playing surface 112).

The upper curved portion 104 (FIG. 1A) and upper curved portion 106 of sidewalls 101, 102, respectively, provide both an esthetic quality as well as containment for tokens 125 tossed at the target game, as momentum carries the tokens 125 into the depth of the game containment area 115 bounded by the horizontal playing surface 112, the upward-sloping portions 104, 106 of sidewalls 101, 102, respectively, and by the vertical playing surface 108. At about the vertical playing surface 108, the upper portion 106 of sidewall 102 levels out and finally terminates at the back wall 326.

Figure 5:
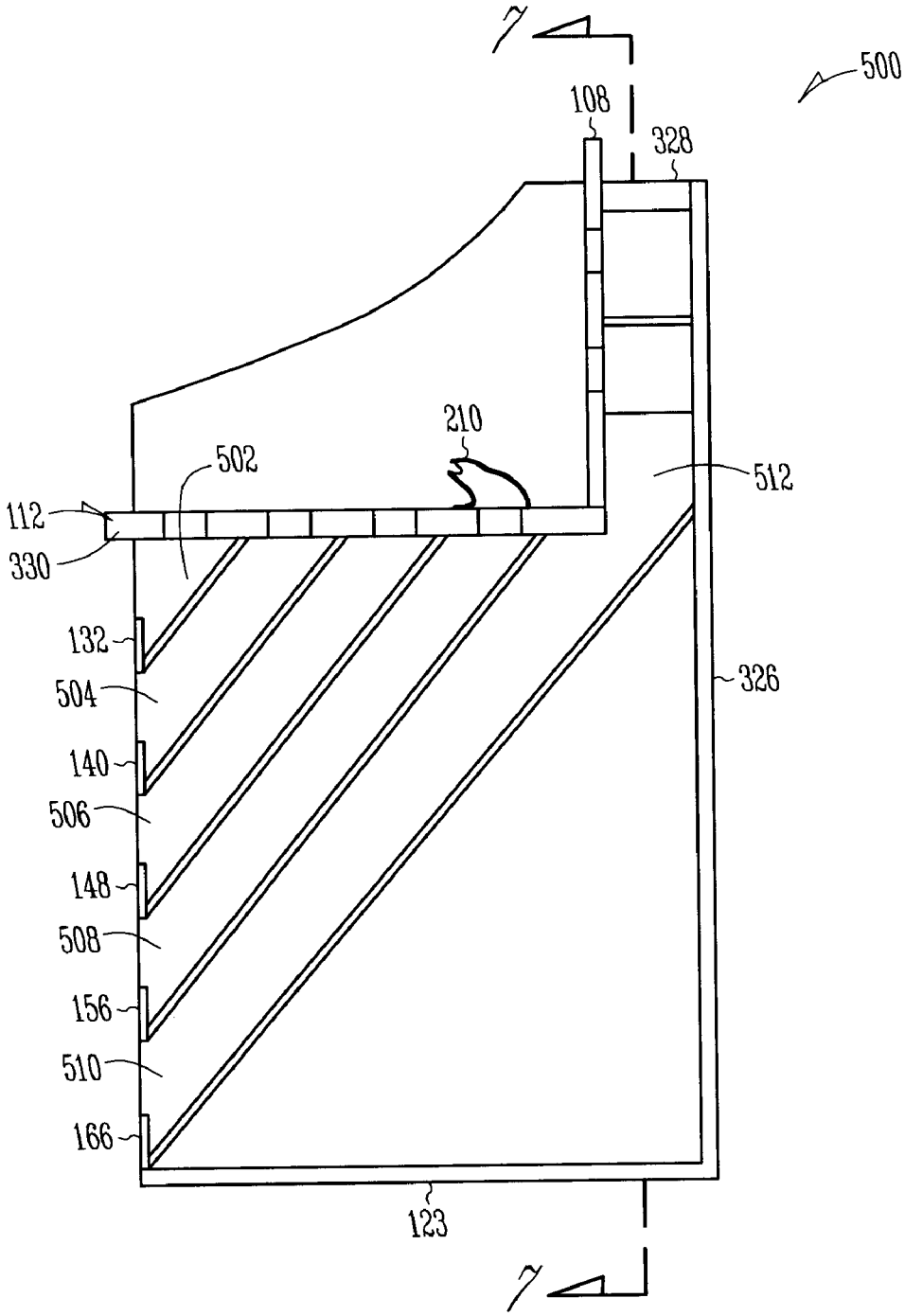
FIG. 5 illustrates a side cross-sectional view of the example target game of FIG. 1A.

FIG. 5 illustrates a side cross-sectional view 500 of the example target game of FIG. 1A. It is noted that door 116 is not shown for clarity. In the cross-sectional view 500, channel surfaces 502-508 allow tokens 125 that fall through apertures 114 on the horizontal playing surfaced 112 to slide toward the front of the target game to be collected or received in scoring bins 124, while channel surface 510 allows tokens 125 that fall through apertures 110 on the vertical playing surface 108 to slide toward the front of the target game to be collected or received in respective scoring bins 124. Channel surfaces 502-510 are generally diagonally disposed within the target game from the back down to the front to allow tokens 125 received through apertures 110, 114 to slide down to the respective scoring bins 124 at the front of the target game.

With reference to FIGS. 2, 3 and 5, each channel surface 502-510 is divided by partitions 216 (FIG. 2) to form respective channels, each of which begins at a particular aperture and terminates at a particular scoring bin. More specifically, channel surface 502 is divided by partitions 216 into three channels leading from apertures 302-306 (FIG. 3) to scoring bins 126-130, respectively. Channel surface 504 is divided by partitions 216 into five channels leading from apertures 307-313 (FIG. 3) to scoring bins 133-139, respectively. Channel surface 506 is divided by partitions 216 into three channels leading from apertures 314-318 (FIG. 3) to scoring bins 142-146, respectively. Channel surface 508 is divided by partitions 216 into five channels leading from apertures 319-325 (FIG. 3) to scoring bins 149-155, respectively. It is noted that apertures 302-325 are on the horizontal playing surface 112.

A vertical cavity 512 is formed between the back wall 326 and the vertical playing surface 108, which is divided by partitions 216 into four channels, each for a respective aperture 202-208 (shown in greater detail in FIG. 7 below). In addition, channel surface 510 is divided by partitions 216 into four channels connecting to respective channels in the vertical cavity 512, thereby providing continuous channels that lead from apertures 202-208 (FIG. 2) to scoring bins 158-164, respectively.

Figure 6:
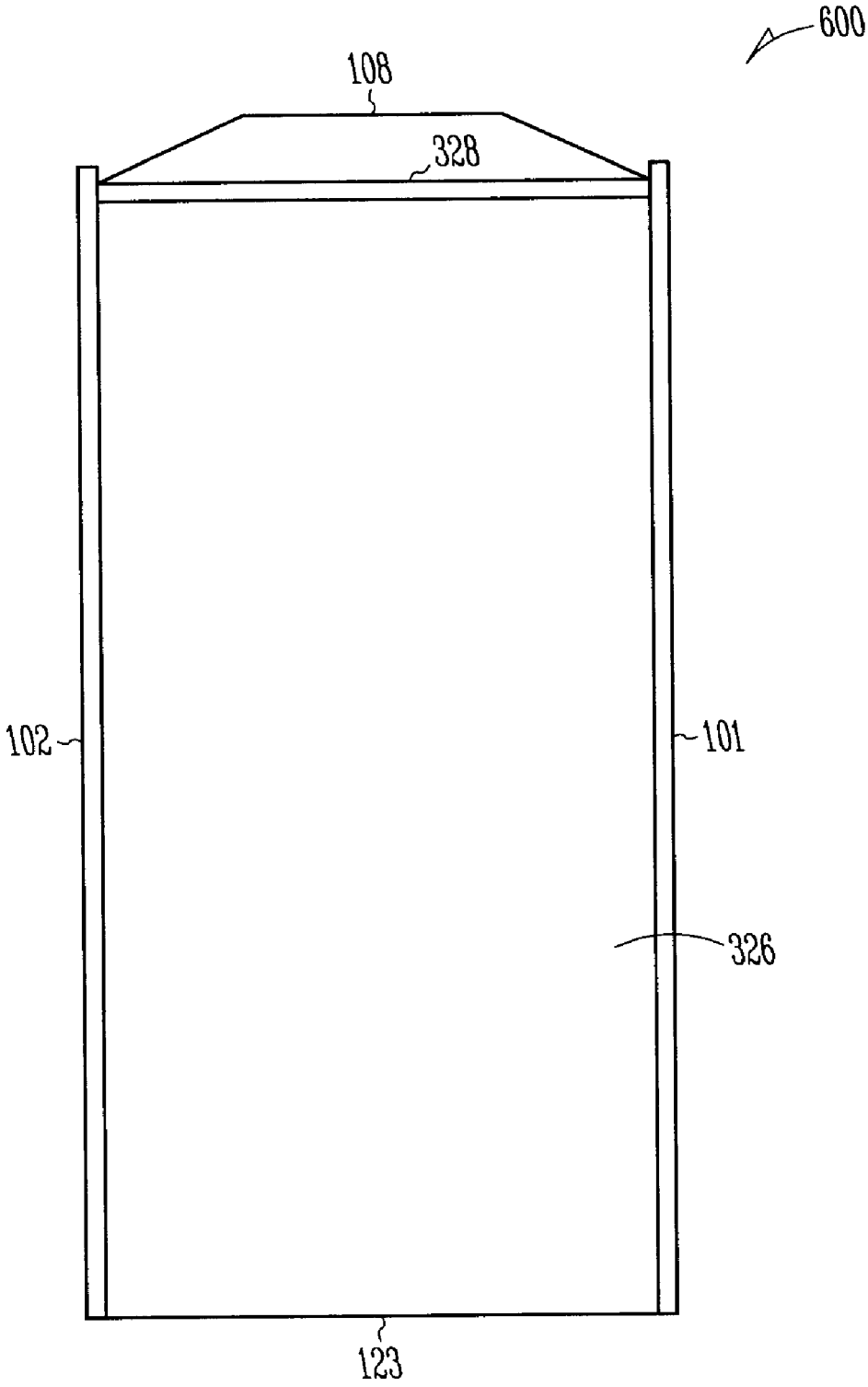
FIG. 6 illustrates a back view of the example target game of FIG. 1A.

FIG. 6 illustrates a back view 600 of the example target game of FIG. 1A. As illustrated in the back view 600, the back wall 326 of the target game is lower than the vertical playing surface 108. Yet, the back wall 326 is sufficiently tall enough to enclose apertures 202-208 of the vertical playing surface 108, forming the vertical cavity 512 (FIG. 5) between the back wall 326 and the vertical playing surface 108 enclosed by top wall 328 and sidewalls 101, 102.

Figure 7:
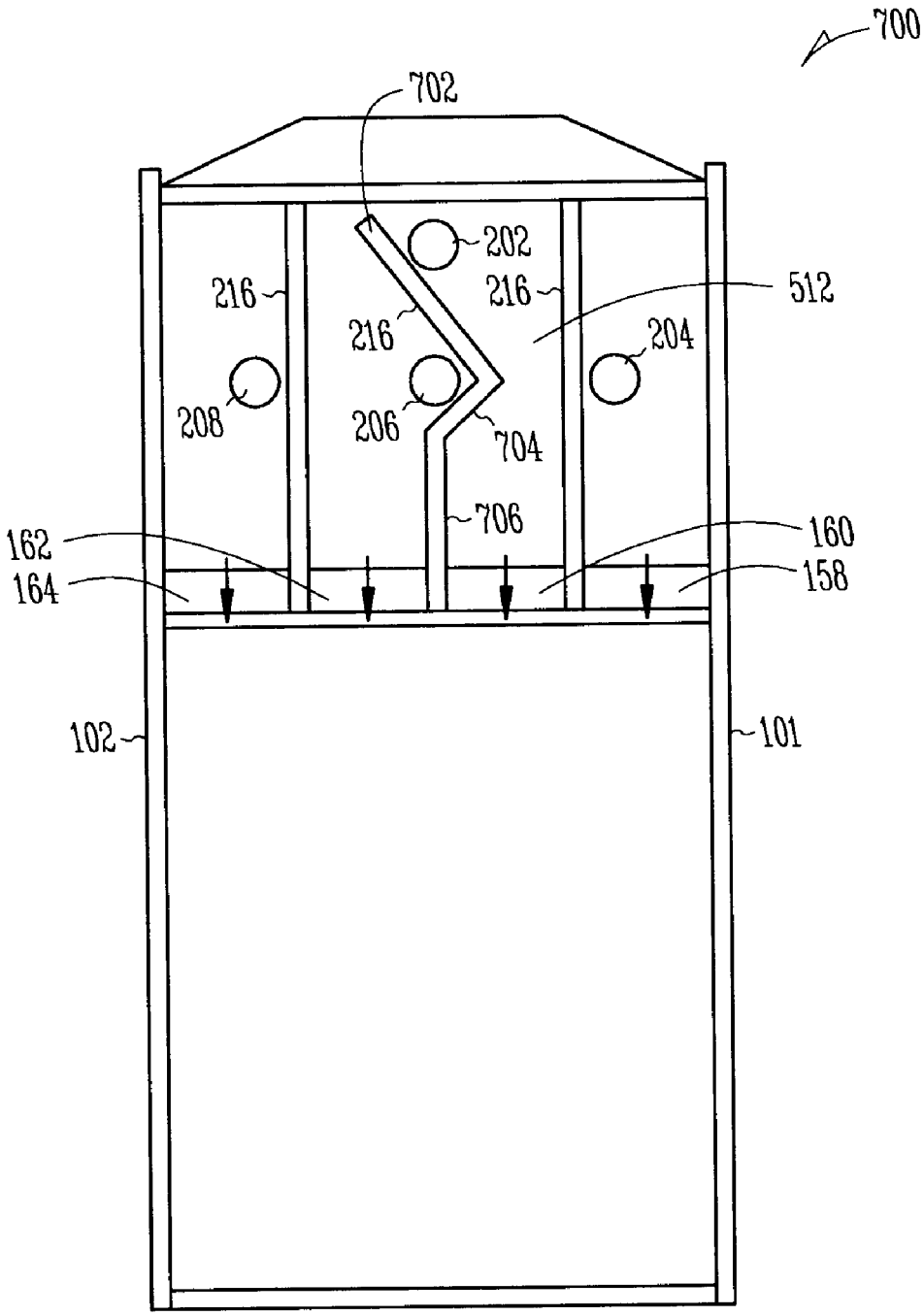
FIG. 7 illustrates a back cross-sectional view of the example target game of FIG. 1A.

FIG. 7 illustrates a back cross-sectional view 700 of the example target game of FIG. 1A. The back cross-sectional view 700 illustrates apertures 110 on the vertical playing surface 108 and partitions 216 (FIG. 2) in the vertical cavity to keep tokens 125 falling through apertures 202-208 segregated so that they may be collected in respective scoring bins 158-164. More specifically, tokens 125 falling through aperture 208 slide to and are collected in scoring bin 164, tokens 125 falling through aperture 206 slide to and are collected in scoring bin 162, tokens 125 falling through aperture 202 slide to and are collected in scoring bin 160, and lastly, tokens 125 falling through aperture 204 slide to and are collected in scoring bin 158.

While lateral partitions 216 are generally straight, the center partition 216 includes sections 702-706, which are at angles with respect to one another to allow tokens 125 falling though apertures 202 and 206 to be segregated into respective scoring bins 160, 162. More specifically, as aperture 202 is vertically above aperture 206 on the vertical playing surface 108, section 702 is oriented diagonally from sidewall 102 to sidewall 101 to allow tokens 125 falling through aperture 202 to slide down the correct channel and be collected in the correct scoring bin 160, while section 704 is oriented diagonally from sidewall 101 to sidewall 102 to allow tokens 125 falling through aperture 202 to slide down the correct channel and be collected in the correct scoring bin 162.

Figure 8:
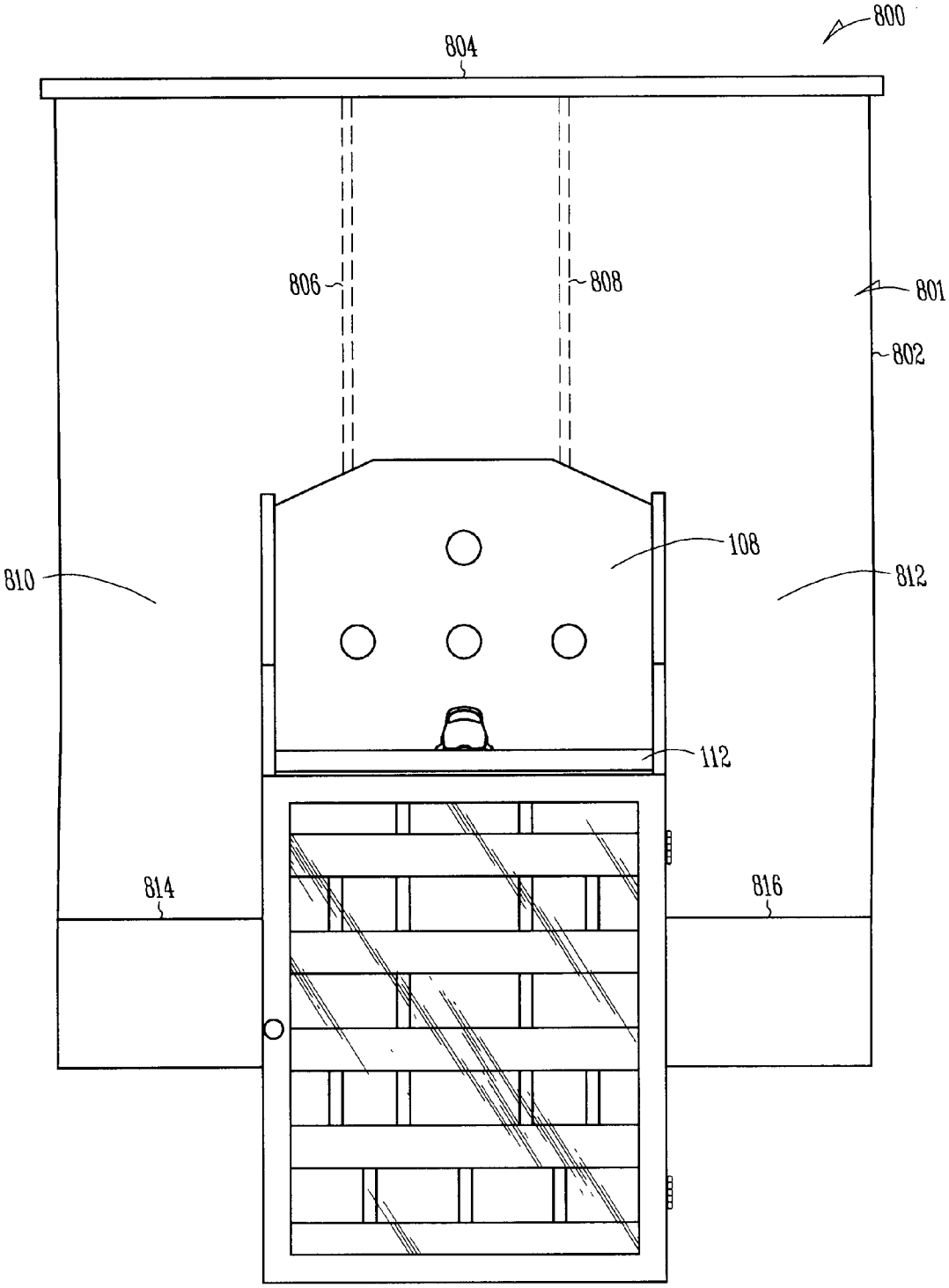
FIG. 8 illustrates a front view of the example target game of FIG. 1A including a containment and advertising curtain assembly.

FIG. 8 illustrates a front view 800 of the example target game of FIG. 1A, which includes a curtain assembly 801. The curtain assembly 801 provides not only containment for the tokens 125 tossed by players at the target game, but also protects the surrounding area (e.g., walls and the like) from the tokens 125 and provides space 810, 812 to receive advertisements, as well as any other written/printed or other material that may be desired. The curtain assembly 801 includes a curtain 802, which is attached to a horizontal bar 804 from which it can be unrolled to appropriate length desired.

The tokens 125 that miss or ricochet off the target game may hit the curtain 812 and thereafter may further slide down into receiving pockets 814, 816 to be collected. Although only receiving pockets 814, 816 are illustrated, it is to be noted that additional one or more receiving pockets may be provided between receiving pockets 814, 816 or anywhere on curtain 802, as may be desired. The bar 804 is supported by vertical assemblies 806 and 808, which will be described in greater detail with reference to FIGS. 9 and 10 below. At this point, it is sufficient to mention that the vertical assemblies 806, 808 are adjustable to lift or lower the curtain assembly 801 in relation to the target game.

Figure 9:
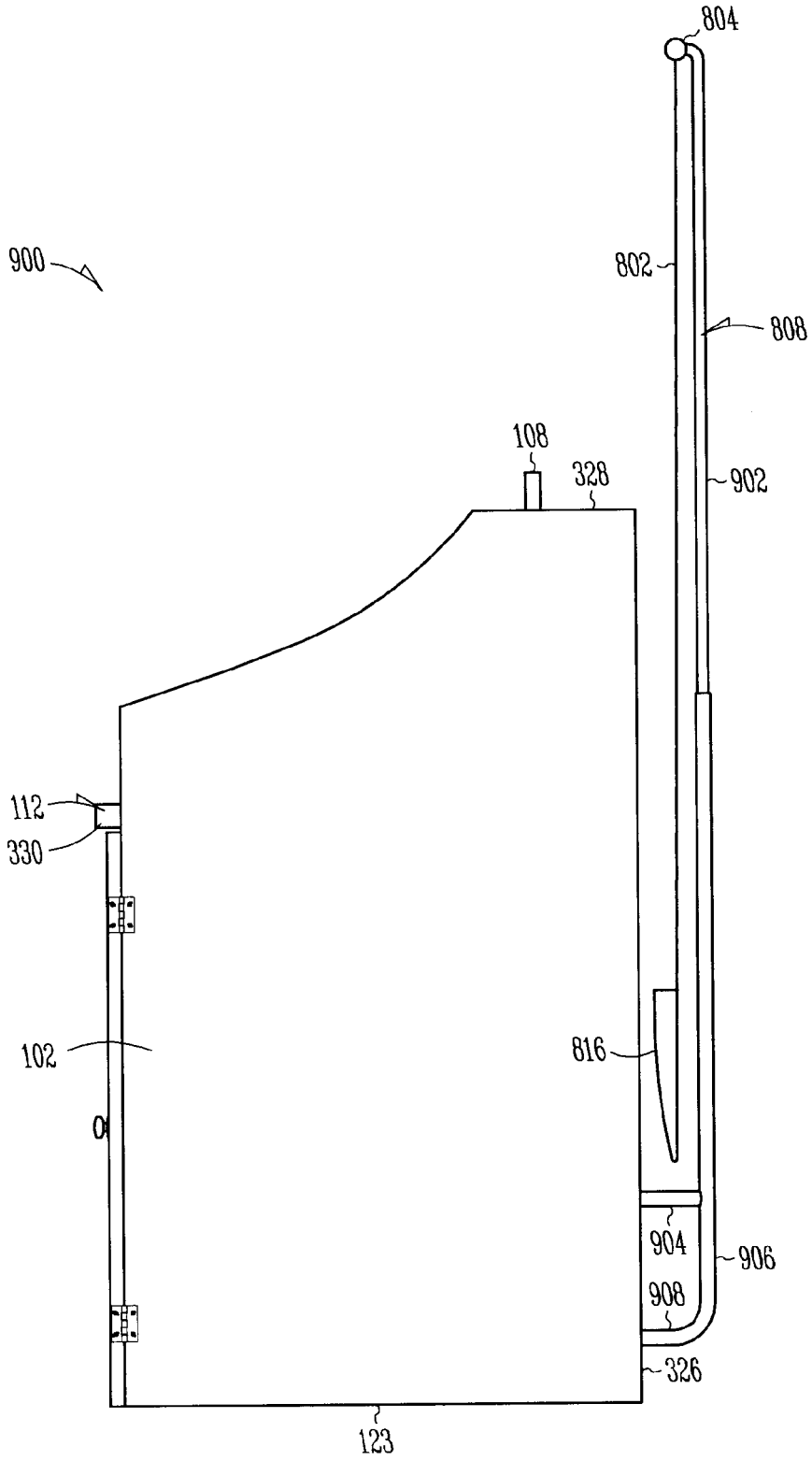
FIG. 9 illustrates a side view of the example target game of FIG. 9.

FIG. 9 illustrates a side view 900 of the example target game of FIG. 8. The side view 900 illustrates a side view of the vertical assembly 808 of the curtain assembly 801 in more detail. It is to be noted that vertical assembly 806 is analogous to vertical assembly 808 described below. As illustrated in side view 900, the curtain 802, which includes receiving pockets 814, 816 (only pocket 816 shown), is attached to a horizontal bar 804 from which it can be unrolled to appropriate length desired. Vertical assembly 808 may include a vertically telescoping rail having an upper portion 902 and a lower portion 906, supported by fixation devices 904, 908.

The fixation devices 904, 908 are attached to the back wall 326. Both fixation devices 904, 908 may include apertures through which vertical assembly 808 may be inserted and the height thereof adjusted. Fixation device 908 may be a terminal fixation device (e.g., without an aperture), which supports the vertical assembly 808 and the height of the vertical assembly 808 may be adjusted via the telescoping rail 902, 906. Alternatively, or in addition, the vertical rail may or may not be non-telescoping and each fixation device 904, 908 may include an aperture, allowing the height of the vertical rail 808 to be adjusted by moving the vertical rail through the apertures of fixation devices 904, 908.

Figure 10:
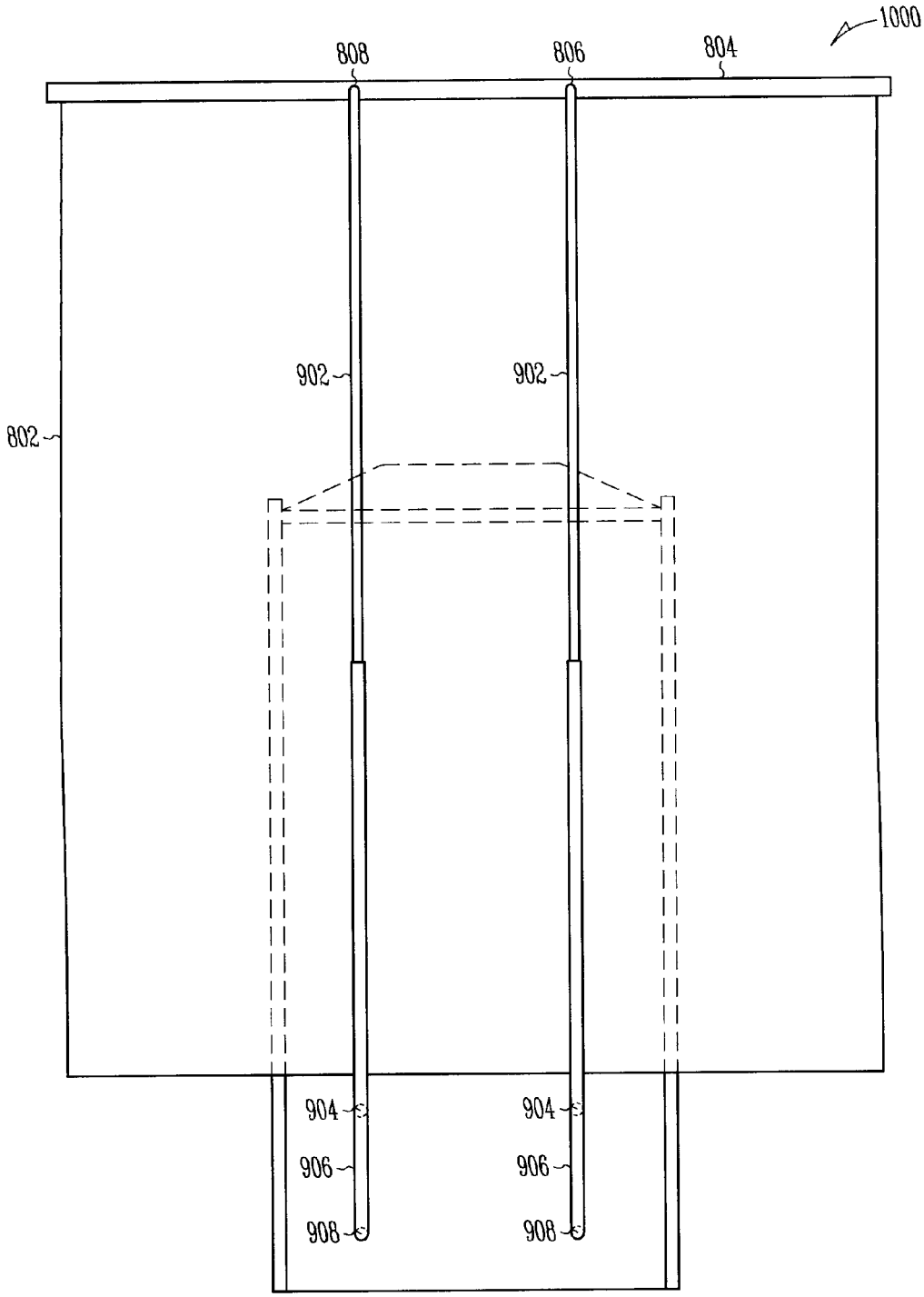
FIG. 10 illustrates a back view of the example target game of FIG. 9.

FIG. 10 illustrates a back view 1000 of the example target game of FIG. 8. In the back view 1000, vertical assemblies 806, 808 of FIG. 8 are illustrated in greater detail. As described above in reference to FIG. 9, vertical assemblies 806, 808 may each include a vertically telescoping rail facilitating height adjustment, having an upper portion 902 and a lower portion 906, supported by fixation devices 904, 908. As also described above, the vertical rail may also be non-telescoping, where height adjustment may be achieved by moving the vertical rails through apertures of fixation devices 904, 908.

In operation, in accordance with FIGS. 1-10, the above-described example target game provides improved game play and enjoyment, increasing requisite skill level to challenge players, providing additional ways of scoring and improving containment during play. The increase in the requisite skill level and additional ways of scoring are obtained, among other feature, by providing, in addition to the horizontal playing surface 112 having a plurality of apertures 114, a vertical playing surface 108 having a plurality of apertures 110 connected to respective scoring bins 124. The different apertures 110, 114 may be used to provide different point structures depending on their difficulty, making the game more challenging and rewarding.

Tokens 125 that fall through the apertures 110, 114 slide through channels toward the front of the target game and are collected in respective scoring bins 124. An esthetically-pleasing game containment area 115 is provided by the vertical playing surface 108, the upwards-slopping upper portions 104, 106 of sidewalls 101, 102, the horizontal playing surface 112 and the extension portion 330 of the horizontal playing surface 112. Dampening materials on the horizontal playing surface 112 and the vertical playing surface 108, the door 116 enclosing the scoring bins 124, as well as the curtain assembly 801, may further provide additional levels of containment during play.

Further with regard to the operation of the example target game in accordance with FIGS. 1-10, a game may be played as follows. The game may be played with at least two players and up to as many players as may be desired (e.g., six players), and the game may include multiple rounds. For each round of the game, a player may receive a predetermined number of tokens 125 (e.g., six tokens). Each player may toss as many tokens 125 at once as the player may desire. For example, the player may toss one token 125 at a time or any number of tokens 125 up to the allotted number of tokens 125. The player may stand a predetermined distance away from the target game. That is, the predetermined distance from the target game may be determined for each game or round thereof, and for different types of players. For example, it may be determined that adults should be at least 12 feet from the target game, while children should be at least 6 feet from the target game. Alternative predetermined distances from the target game may easily be determined and utilized.

The points for each player are accumulated by adding scores for each of the allotted tokens 125, using point values indicated on respective scoring bins 124 corresponding to the associated apertures 110, 114 on the horizontal and vertical playing surfaces 108, 112, respectively, which receive tokens 125. A player that collects a particular total score (e.g., total score of 50,000 points) via one or more rounds wins the game. Various scores may be assigned to apertures 110, 114 based on difficulty or other criteria. If a player does not score during a round, the player is penalized by having to subtract a number of hundreds from a player's total score. For example, if the player has a total score of 2,700 points through a particular number of rounds played, and during a next round scores no points, 700 points are subtracted from the players score, leaving a total score of 2,000. As another example, if a player has a total score of zero through a particular number of rounds, and during a next round scores no points, the player still will have a total score of zero.

Furthermore, the tossed tokens 125 must first touch the vertical playing surface 108 or the horizontal playing surface 112 in order to score points. For example, if a token 125 hits one of the sidewalls 101, 102 first and bounces into one of the apertures 110, 114, it does not count. If a token 125 lands on the horizontal playing surface 112 and is subsequently pushed in by another token 125, the points of the token 125 that is pushed in count.

A bonus may be added to the total score, where three tokens 125 that land in the same aperture 110, 114 count as four tokens 125. If all tokens 125 allotted during a round (e.g., six tokens) land on the horizontal playing surface 112 without falling into any of the apertures 110, 114, the player receives a bonus of 1,000 points. However, if all tokens 125 allotted during a round (e.g., six tokens) fall into apertures 110, 114, the player receives a bonus of 3,000 points. If a token 125 is tossed into Sapo's mouth, the player yells "Sapo" and receives a bonus of 25,000 points. As noted above, a player that collects a particular total score (e.g., 50,000 points) via one or more rounds wins the game. Alternate scoring systems may easily be employed as desired.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the description. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

What is claimed is:

1. A target game to receive tokens into apertures having associated scores, the target game comprising:

a first playing surface including a plurality of first apertures;

a second playing surface intersecting the first playing surface and extending above from the first playing surface, the second playing surface including a plurality of second apertures; and a plurality of scoring bins disposed below the first playing surface and in communication with the first apertures and the second apertures, each of the scoring bins in communication with a respective aperture of the first apertures and the second apertures.

2. The target game of claim 1, wherein the first apertures are disposed in a first spaced relationship with respect to the first playing surface.

3. The target game of claim 2, wherein the first spaced relationship includes a plurality of rows, each of the plurality of rows including at least one aperture.

4. The target game of claim 1, wherein the second apertures are disposed in a second spaced relationship with respect to the second playing surface.

5. The target game of claim 4, wherein second spaced relationship includes a plurality of rows, each of the plurality of rows including at least one aperture.

6. The target game of claim 1, wherein the scoring bins are arranged in a plurality of tiers, the tiers including at least a first tier corresponding to the first apertures and a second tier corresponding to second apertures.

7. The target game of claim 1, further comprising a channel to provide communication between each of the scoring bins and the respective aperture.

8. The target game of claim 1, wherein at least one of the first playing surface and the second playing surface includes a dampening material to dampen momentum of tokens.

9. The target game of claim 1, wherein an aperture of the first apertures includes a frog thereover, the frog's mouth in communication with the aperture.

10. The target game of claim 1, further comprising a curtain assembly including a curtain disposed behind the second playing surface, the curtain being adjustable to a predetermined height above the second playing surface and extending to a predetermined width at least on one side of a left side and a right side of the second playing surface.

11. The target game of claim 10, wherein the curtain includes at least one receiving pocket to receive at least one token.

12. A target game to receive tokens into apertures having associated scores, the target game comprising:

a housing including at least opposing sidewalls and a top wall, the top wall disposed between and extending along the opposing sidewalls, the top wall being configured as a first playing surface including a plurality of first apertures;

a second playing surface intersecting the first playing surface and extending above from the first playing surface, the second playing surface including a plurality of second apertures; and a plurality of scoring bins disposed in the housing and in communication with the first apertures and the second apertures, each of the scoring bins in communication with a respective aperture of the first apertures and the second apertures.

13. The target game of claim 12, wherein the scoring bins are arranged in a plurality of tiers, the tiers including at least a first tier corresponding to the first apertures and a second tier corresponding to second apertures.

14. The target game of claim 12, further comprising a channel to provide communication between each of the scoring bins and the respective aperture.

15. The target game of claim 12, wherein each of the opposing sidewalls includes a curved upper portion having a low profile at about a front of the first playing surface and upwardly-curving to about a back of the first playing surface and up to about a top of the second playing surface to form a game containment area.

16. The target game of claim 12, wherein the housing includes a door rotatably affixed to one of the sidewalls.

17. The target game of claim 16, wherein the door includes a translucent portion to allow viewing of the plurality of scoring bins.

18. The target game of claim 12, wherein the first playing surface includes an extension portion at a front part thereof that extends out beyond the opposing sidewalls.

19. The target game of claim 12, further comprising a curtain assembly including a curtain disposed behind the second playing surface, the curtain being adjustable to a predetermined height above the second playing surface and extending to a predetermined width beyond at least one of the opposing sidewalls.

20. The target game of claim 19, wherein the curtain includes at least one receiving pocket to receive at least one token.

* * * * *

UNITED STATES PATENT AND TRADEMARK OFFICE

CERTIFICATE OF CORRECTION

PATENT NO. : 7,900,928 B2
APPLICATION NO. : 12/689777
DATED : March 8, 2011
INVENTOR(S) : Held et al.

It is certified that error appears in the above-identified patent and that said Letters Patent is hereby corrected as shown below:

IN THE SPECIFICATIONS:

Column 5, line 29:

Now reads: "in front the target game"

Should read: -- in front of the target game --

Column 6, line 11:

Now reads: "horizontal playing surfaced 112"

Should read: -- horizontal playing surface 112 --

Signed and Sealed this
Twenty-eighth Day of August, 2012

David J. Kappos

David J. Kappos
*Director of the United States Patent and Trademark Office*